US006835166B1

(12) United States Patent
Stearns et al.

(10) Patent No.: US 6,835,166 B1
(45) Date of Patent: Dec. 28, 2004

(54) EXERCISE APPARATUS WITH ELLIPTICAL FOOT MOTION

(76) Inventors: Kenneth W. Stearns, P.O. Box 55912, Houston, TX (US) 77255; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 10/633,042

(22) Filed: Aug. 1, 2003

(51) Int. Cl.[7] ..... A63B 22/02
(52) U.S. Cl. ..... 482/52; 482/70; 482/57
(58) Field of Search ..... 482/51–54, 57, 482/70, 79–80

(56) References Cited

U.S. PATENT DOCUMENTS 5,336,146 A * 8/1994 Piaget et al. ..... 482/54
5,792,029 A * 8/1998 Gordon ..... 482/52
6,302,830 B1 * 10/2001 Stearns ..... 482/70
6,461,279 B1 * 10/2002 Kuo ..... 482/54
6,575,877 B2 * 6/2003 Rufino et al. ..... 482/51

* cited by examiner

*Primary Examiner*—Stephen R. Crow

(57) ABSTRACT

An exercise apparatus includes a frame; a front crank rotatably mounted on the frame; a rear crank rotatably mounted on the frame; left and right rails rotatably interconnected between respective portions of the front crank and respective portions of the rear crank; left and right foot supports movably mounted on respective rails; left and right rocker links pivotally mounted on the frame and operatively, connected to respective foot supports; and left and right drive links movably interconnected between respective front cranks and respective rocker links. The resulting assembly constrains the rails to move through respective circular paths relative to the frame, and constrains the foot supports to move back and forth relative to the rails in a manner that generates elliptical foot paths.

20 Claims, 6 Drawing Sheets

EXERCISE APPARATUS WITH ELLIPTICAL FOOT MOTION

FIELD OF THE INVENTION

The present invention relates to exercise methods and apparatus and more particularly, to exercise equipment that facilitates movement of a person's feet through generally elliptical paths.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to ski and/or stride in place. Yet another type of exercise equipment has been designed to facilitate relatively more complicated exercise motions and/or to better simulate real life activity. This equipment typically uses a linkage assembly to convert a relatively simple motion, such as circular, into a relatively more complex motion, such as elliptical. For examples, see U.S. Pat. No. 4,185,622 to Swenson; U.S. Pat. No. 5,279,529 to Eschenbach; U.S. Pat. No. 5,383,829 to Miller; U.S. Pat. No. 5,540,637 to Rodgers, Jr.; U.S. Pat. No. 5,882,281 to Stearns et al.; and U.S. Pat. No. 6,080,086 to Maresh et al.

SUMMARY OF THE INVENTION

Generally speaking, the present invention provides novel linkage assemblies and corresponding exercise apparatus that facilitate coordinated total body exercise. On a preferred embodiment, a rear crank is rotatably mounted on a rearward portion of a frame, and a front crank is rotatably mounted on an opposite, forward portion of the frame. Left and right rails are interconnected between respective portions of the front crank and respective portions of the rear crank, and left and right foot supports are movably mounted on respective rails. Left and right rocker links are pivotally mounted on the frame, and operatively connected to respective foot supports. The rocker links have upper distal ends that are sized and configured for grasping.

Left and right drive links are movably interconnected between the front crank and respective rocker links. The resulting assembly constrains the rails to move through respective circular paths relative to the frame, while also constraining the foot supports to move back and forth relative to respective rails to generate elliptical paths of foot motion.

Among other things, the present invention may be considered advantageous to the extent that the foot supports remain in a single, desirable orientation during exercise activity. Also, the drive links may be adjusted relative to the rocker links to adjust the elliptical foot paths in a manner that similarly adjusts the handlebar paths. The adjustments to the foot paths also move the user relatively further rearward as the foot paths increase in length. Additional features and/or advantages of the present invention will become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
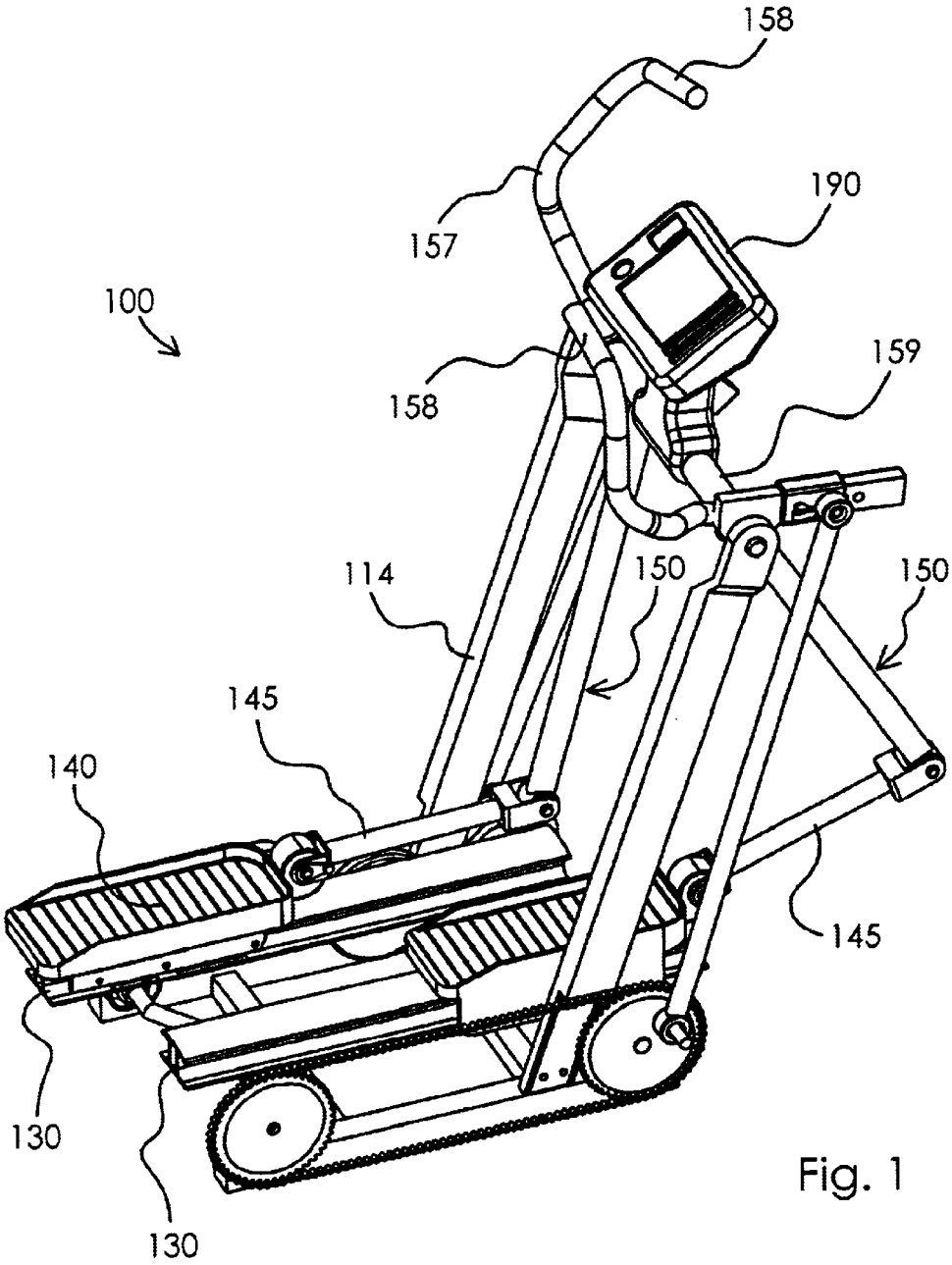
FIG. 1 is a perspective view of an exercise apparatus constructed according to the principles of the present invention.

The present invention involves elliptical motion exercise machines and methods that link rotation of front and rear cranks to generally elliptical motion of left and right foot supports, and reciprocal motion of left and right handlebars. The term "elliptical motion" is intended in a broad sense to describe a closed path of motion having a relatively longer, major axis and a relatively shorter, minor axis (which extends perpendicular to the major axis). In general, the present invention may be said to use displacement of the cranks to move the foot supports in a direction coincidental with the minor axis, and displacement of crank driven members to move the foot supports in a direction coincidental with the major axis. As a result, the crank diameter determines the length of the minor axis, but the length of the major axis may be varied independent of the crank diameter.

The embodiments disclosed herein are generally symmetrical about a vertical plane extending lengthwise through a floor-engaging base. However, linkage assembly components on the left side of the machines are typically one hundred and eighty degrees out of phase relative to their opposite side counterparts. Also, to the extent that reference is made to forward or rearward portions of a machine, it is to be understood that a person can typically exercise while facing in either direction relative to the disclosed linkage assembly. Furthermore, the term "axially" may be used herein to described along an axis or in a direction parallel to the axis. Also, "generally vertical" may be used to describe a structural relationship wherein a member is more vertical than horizontal. Recognizing that members may be configured in various ways, directional descriptions, including "generally vertical", for example, shall be interpreted with reference to connection points on the member in question.

A preferred embodiment of the present invention is designated as 100 in FIGS. 1-5. The machine 100 generally includes a frame 110; left and right linkage assemblies movably mounted on the frame 110 (and linked to one another); and a user interface 190 mounted on the frame 110. The interface 190 may be designed to perform a variety of functions, including (1) displaying information to the user regarding items such as (a) exercise parameters and/or programs, (b) the current parameters and/or a currently selected program, (c) the current time, (d) the elapsed exercise time, (e) the current speed of exercise, (f) the average speed of exercise, (g) the number of calories burned during exercise, (h) the simulated distance traveled during exercise, and/or (i) internet data; and (2) allowing the user to (a) select or change the information being viewed, (b) select or change an exercise program, (c) adjust the speed of exercise, (d) adjust the resistance to exercise, (e) adjust the orientation of the exercise motion, and/or (f) immediately stop the exercise motion.

The frame 110 includes a floor engaging base 112, and a forward stanchion 114 that extends upward from opposite sides of the base 112, proximate the front end of the frame 110. The forward stanchion 114 may be described as an inverted U-shaped member having a middle portion or console portion that supports the user interface 190, and generally vertical leg portions that define a gap therebetween. The console portion may be configured to support additional items, including a water bottle, for example.

A rear crank is rotatably mounted on the base 112 via left and right bearing assemblies 122 for rotation about a rear crank axis. The rear crank includes left and right crank arms 120 that extend radially away from the rear crank axis; left and right supports 124 that are rigidly secured to radially displaced portions of respective crank arms 120 to define respective, diametrically opposed axes (that extend parallel to the rear crank axis); and an intermediate bar 125 that is rigidly interconnected between the inward ends of the diametrically opposed supports 124. The bar 125 enhances structural integrity and constrains the left and right rear crank arms 120 to remain one hundred and eighty degrees out of phase with one another.

Figure 6:
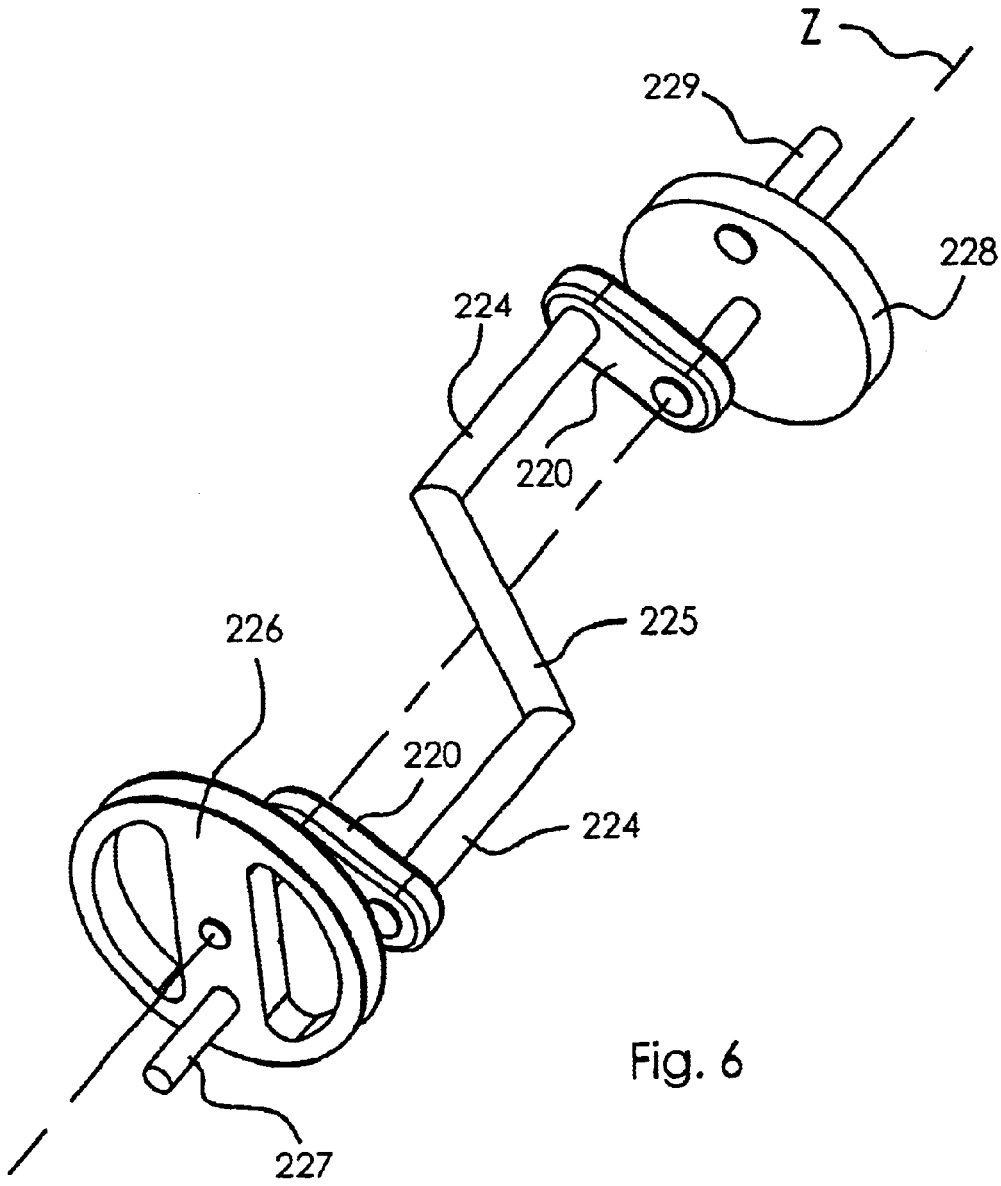
FIG. 6 is a perspective view of a forward crank on the exercise apparatus of FIG. 1.

A front crank is rotatably mounted on the base 112 via left and right bearing assemblies 222 for rotation about a forward crank axis (designated as Z in FIG. 6). The front crank includes left and right cranks arms 220 that extend radially away from the front crank axis; left and right supports 224 that are rigidly secured to radially displaced portions of respective crank arms 220 to define respective, diametrically opposed axes (that extend parallel to the forward crank axis); and an intermediate bar 225 that is rigidly interconnected between the inward ends of the diametrically opposed supports 224. The bar 225 enhances structural integrity and constrains the left and right crank arms 220 to remain one hundred and eighty degrees out of phase with one another.

As shown in FIG. 6, the front crank also includes outboard crank discs 226 and 228 that are disposed outside respective crank arms 220 and rigidly secured thereto via respective shafts. For reasons discussed below, a peg 227 protrudes axially outward from the left crank disc 226, and the peg 227 "trails" the support 224 associated with the left crank arm 220 by 62.5 degrees when the machine 100 is operated in a "forward" moving mode. Similarly, a peg 229 protrudes axially outward from the right crank disc 228, and the peg 229 "trails" the support 224 associated with the right crank arm 220 by approximately sixty degrees when the machine 100 is operated in a "forward" moving mode.

The front crank is linked to the rear crank by means of a chain 102. In this regard, a sprocket 108 is rigidly secured to the crank disc 228, and a similar crank disc 228 and sprocket 108 are rigidly connected to the right rear crank arm 120 (in the same manner as shown in FIG. 6 for the right front crank arm 220). The chain 102 is routed about the sprockets 108, and maintains a synchronized relationship between the rear crank and the front crank, wherein both right crank arms 120 and 220 occupy like orientations relative to the frame 110, and both left crank arms 120 and 220 occupy like orientations relative to the frame 110.

Various known inertia altering devices may also be connected to the cranks. For example, the machine 100 is shown with a flywheel 208 that is connected in "stepped-up" fashion to the crank disc 226. In this regard, a belt 202 is secured about both the crank disc 226 and a relatively smaller diameter pulley 204. The smaller diameter pulley 204 is rotatably mounted on the frame 110 for rotation together with a relatively larger diameter pulley 205. Another belt 206 is secured about both the larger diameter pulley 205 and another smaller diameter pulley 207. This smaller diameter pulley 207 is rotatably mounted on the frame 110 for rotation together with the flywheel 208. As a result of this arrangement, the flywheel 208 rotates at many times the speed of the crank arms 120 and 220.

Figure 2:
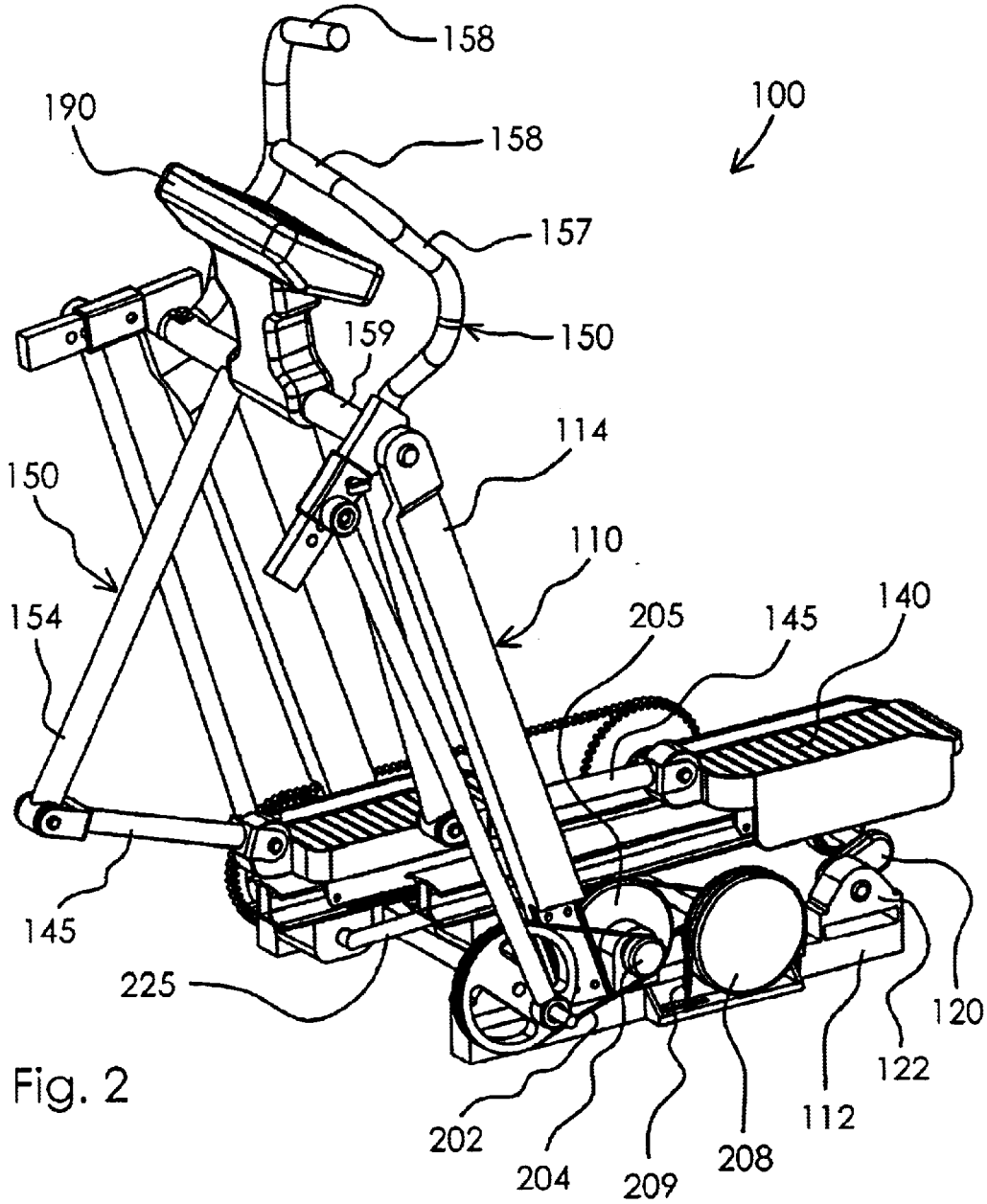
FIG. 2 is another perspective view of the exercise apparatus of FIG. 1.
Figure 3:
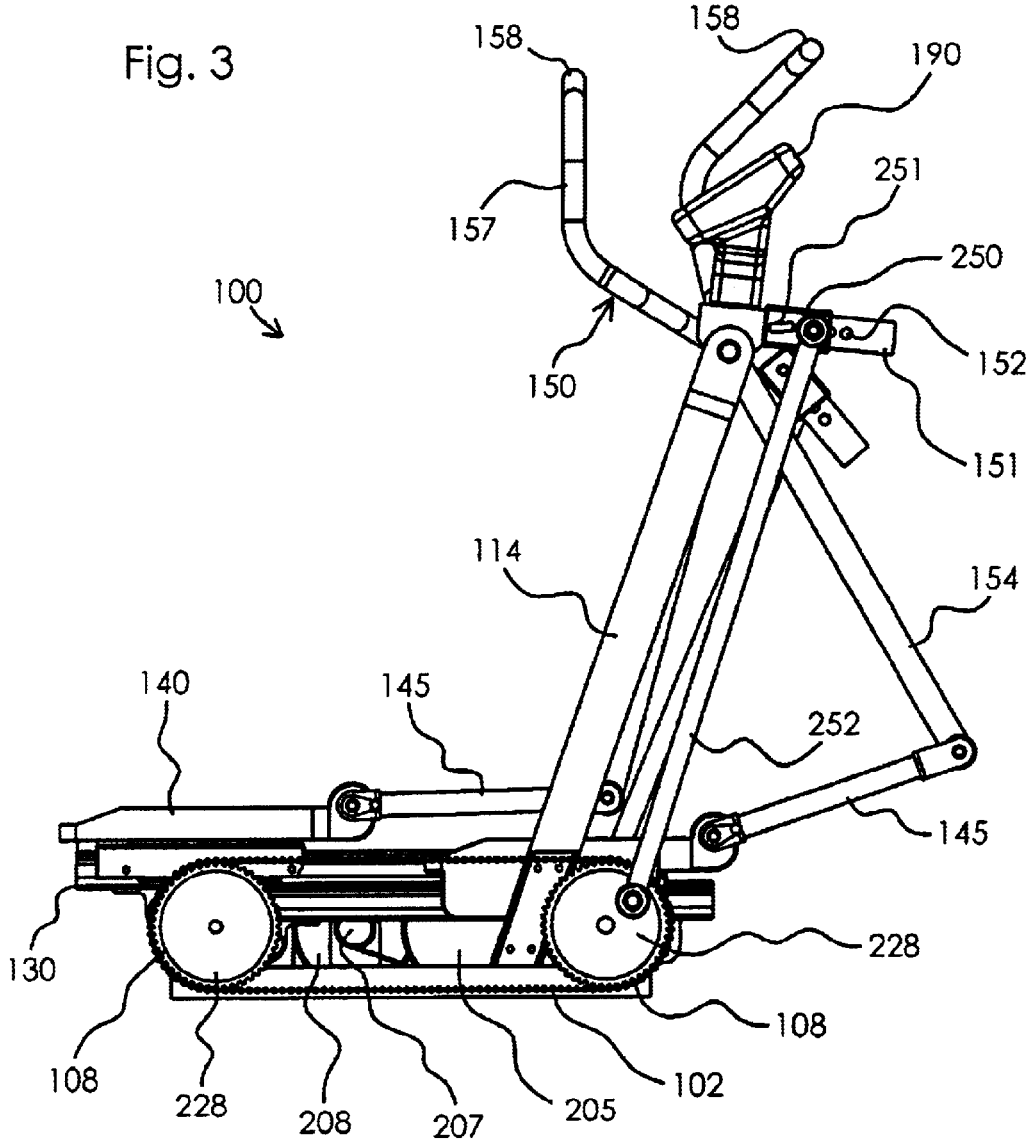
FIG. 3 is a side view of the exercise apparatus of FIG. 1.
Figure 4:
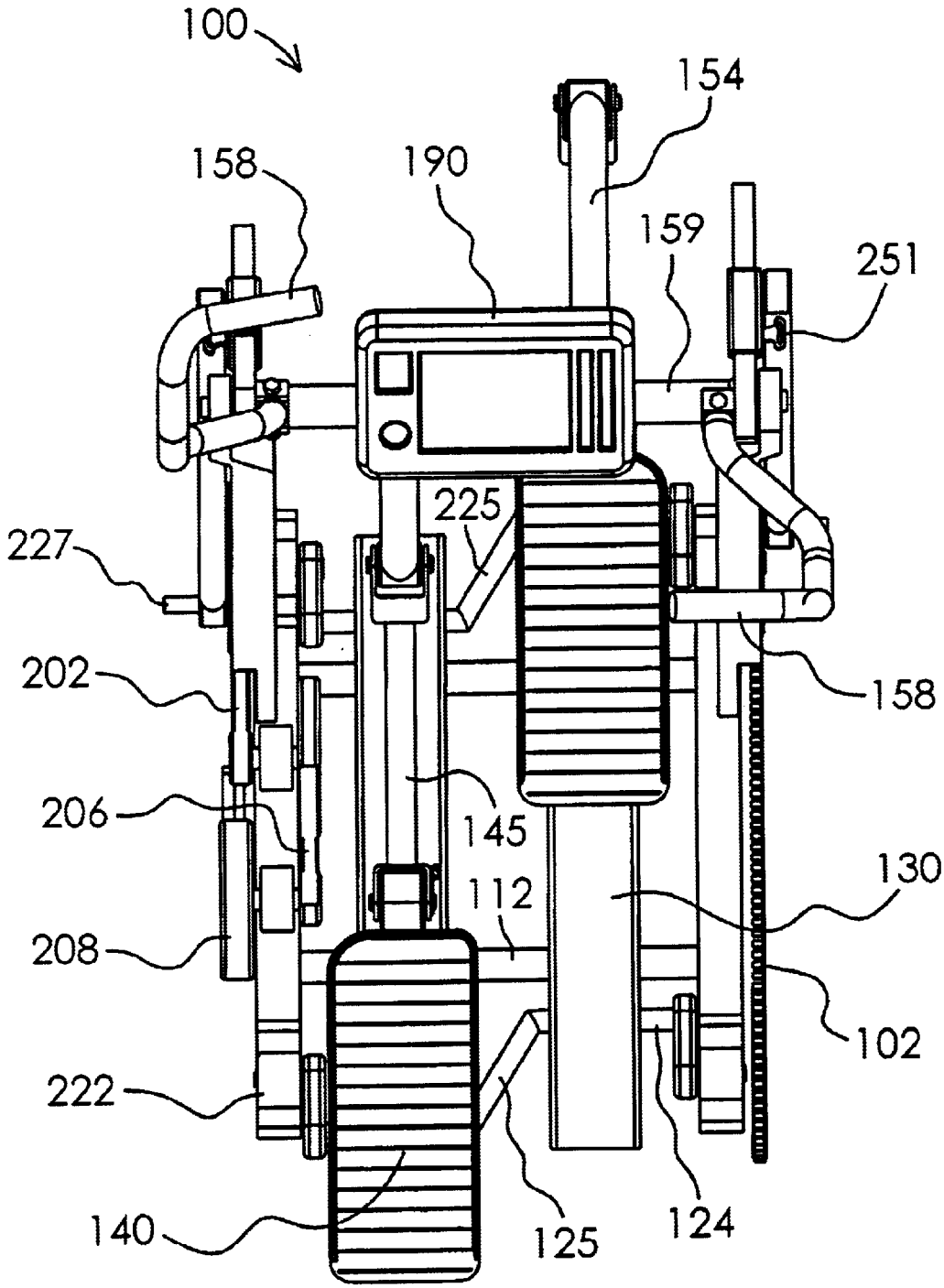
FIG. 4 is a top view of the exercise apparatus of FIG. 1.

FIG. 2 shows the machine 100 with an optional drag strap arrangement included thereon. In particular, a drag strap 209 is routed about one-half of a circumferential groove in the flywheel 208. A rearward end of the drag strap 209 is anchored to an extension of the base 112, and a forward end of the drag strap 209 is connected to a tensioning device that operates in a manner known in the art. The tensioning device may be linked to the user interface 190 to facilitate adjustment of resistance to exercise by a person standing on the foot supports 140. Other known resistance devices, such as an eddy current brake, may be substituted for the drag strap arrangement.

Each linkage assembly also includes a rail 130 having a rearward end that is movably supported on a respective rearward support 124, and an opposite, forward end that is movably supported on a respective forward support 224. One way to support the rails 130 is disclosed in U.S. Pat. No. 4,786,050 to Geschwender, which is incorporated herein by reference. An alternative way to support the rails 130 is to provide "horizontally forgiving" pivot joints at each junction between the rails 130 and the supports 124 and 224. These pivot joints accommodate rotation of the supports 124 and 224 relative to the rails 130, and also accommodate a relatively small amount of horizontal travel of the rails 130 relative to the supports 124 and 224 (to allow for manufacturing tolerances). One example of such a joint includes a split bushing disposed about a respective support 124 or 224 and encased in a rubber block that is secured to a respective rail 130. Another example includes an inverted U-shaped bushing that is draped over a respective support 124 or 224 and movably connected to a respective rail 130 with a block of rubber sandwiched therebetween. Either such arrangement constrains the rails 130 to move through circular paths in response to rotation of the cranks 120 and 220 (with enough "play" or "compliance" in the linkage assemblies to overcome any potential for "locking up" during operation).

Figure 5:
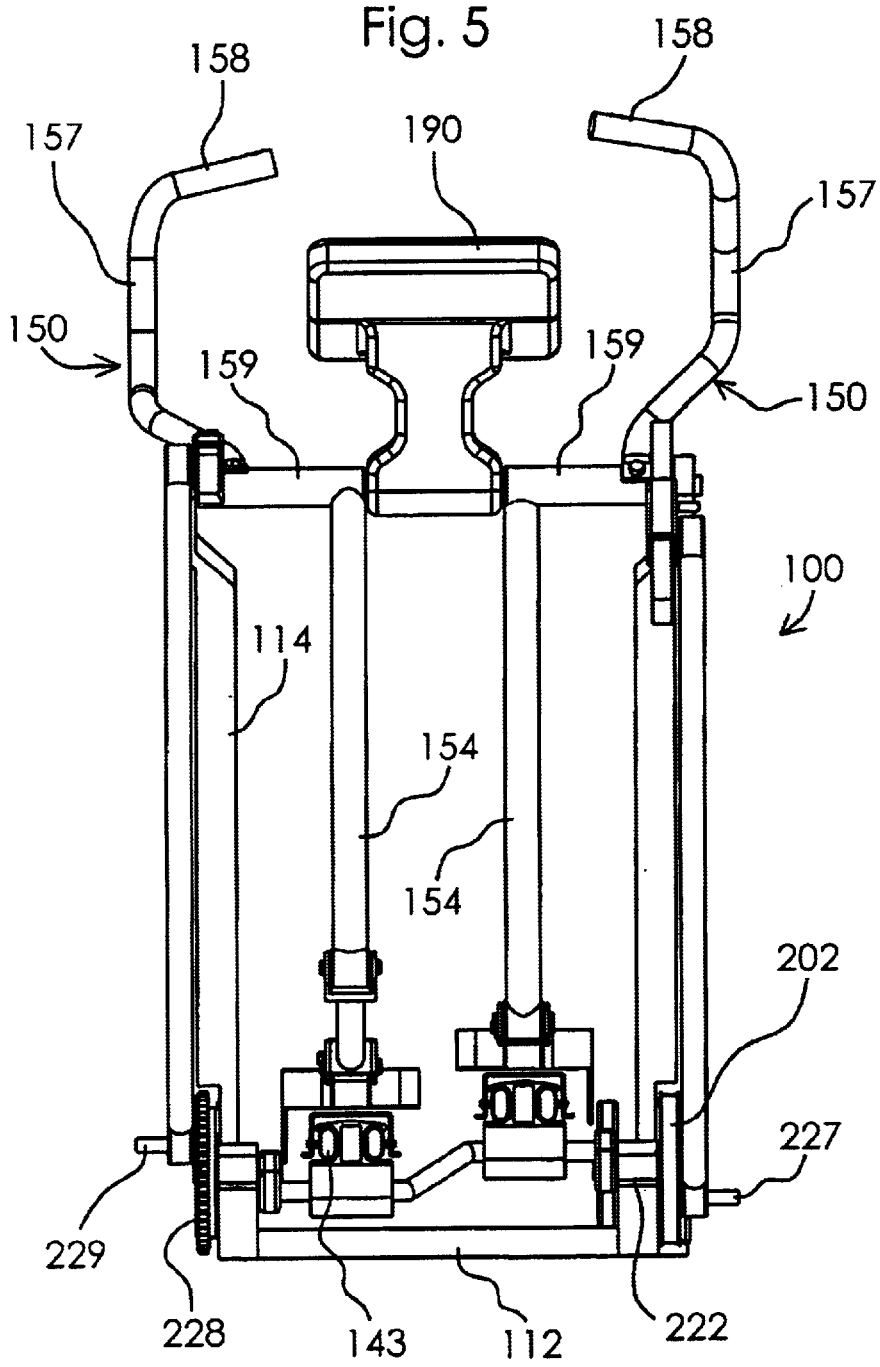
FIG. 5 is a front view of the exercise apparatus of FIG. 1.

Each linkage assembly also includes a foot support or skate 140 movably mounted on a respective rail 130. As shown in FIG. 5, rollers 143 are preferably rotatably mounted on the foot supports 140, and rollable along respective rails 130 to facilitate a smooth gliding interface therebetween. In any event, the foot supports 140 may be described as constrained to move vertically together with respective rails 130, but free to move horizontally relative to respective rails 130.

Each linkage assembly also includes a rocker link 150 pivotally mounted on a respective side of the stanchion 114 and pivotal about a common pivot axis. On the embodiment 100, each rocker link 150 is pivotally mounted on a common support shaft that spans the stanchion 114. Each rocker link 150 includes a horizontally extending, tubular portion 159 that is rotatably mounted on the common support shaft (on opposite sides of the user interface 190). Each rocker link 150 also includes an upper portion 157 having a first end that is rigidly secured to an outer end of a respective tube 159, and an opposite, distal end or handle 158 that is sized and configured for grasping.

Each rocker link 150 further includes a lower portion 154 having a first end that is rigidly secured to an inner end of a respective tube 159, and an opposite end that is pivotally connected to a forward end of a respective link 145. An opposite, rearward end of each link 145 is rotatably connected to the forward end of a respective foot support 140. This arrangement links pivoting of the rocker links 150 to back and forth movement of respective foot supports 140.

Each rocker link 150 further includes a lever arm 151 having a first end that is rigidly secured to an outer end of a respective tube 159 (just outside a respective upper portion 157), and an opposite, distal end that is disposed forward of the stanchion 114. Each lever arm 151 and associated lower portion 154 define an angle of approximately 55 degrees therebetween. For purposes of this description, this angle of "approximately 55 degrees" may alternatively be described in terms of a range of forty to seventy degrees.

Multiple holes 152 extend laterally through each lever arm 151. Each linkage assembly also includes a slide block 250 slidably mounted on a respective lever arm 151. A detent pin, pop pin, or other suitable fastener 251 is inserted through a hole in the slide block 250 and an aligned hole 152 in the lever arm 151 to selectively secure the slide block 250 in place along the lever arm 250. The location of the slide block 250 relative to the lever arm 151 affects the magnitude of exercise motion as discussed below.

Each linkage assembly also includes a drive link 252 having an upper end that is rotatably connected to a respective slide block 250, and an opposite, lower end that is rotatably connected to a respective peg 228 or 229. This arrangement links rotation of the front crank to pivoting of the rocker links 150 (and thus, to back and forth movement of the foot supports 140), and constrains the handles 158 and the foot supports 140 to move in a natural, "cross-crawl" fashion. For example, the left handle 158 moves rearward as the left foot support 140 moves forward, and vice versa.

The extent of exercise movement (or the magnitude of the exercise stroke) may be adjusted by repositioning the slide blocks 250 along respective lever arms 151. The stroke is increased by moving the blocks 250 toward the handlebar pivot axis, and the stroke is decreased by moving the blocks 250 away from the handlebar pivot axis. The adjustments are made manually on the machine 100, but means, such as linear actuators, may be used to automatically make adjustments in response to a control signal.

An advantage of the machine 100 is that essentially the entire length of the machine 100 is available for accommodating movement of a person's feet through desirable elliptical paths. In other words, both the footprint or planform of the machine 100 and the space needed for its operation are relatively small in comparison to the available stride length. The machine 100 may also be considered advantageous to the extent that the stride length is not limited by the diameter or stroke of any of the crank arms 120 and 220.

Another desirable feature of the machine 100 is that the foot supports 140 are positioned in close proximity to one another, thereby accommodating foot motion which may be considered a better approximation of real life activity. In this regard, the opposite side crank arms 120 and 220 eliminate the need for a frame supported bearing assembly between the foot supports 140. In the absence of a central bearing assembly, one or more shields or guards may be disposed between the opposite side foot supports 140 in order to eliminate pinch points.

Yet another advantage of the machine 100 is that the magnitude of hand movement is linked to the magnitude of foot movement. In other words, an increase in the stroke length of the foot supports 140 occurs simultaneously with an increase in the stroke length of the handles 158. Also, the machine 100 is configured in such a manner that the geometric center of the foot path (or the midpoint of the associated major axis) moves increasingly rearward from the front stanchion 114 as the stroke length is increased. This may be considered beneficial to the extent that taller people tend to take longer strides and tend to have longer arms that can reach further forward.

The present invention is disclosed with reference to particular embodiments and specific applications, but this disclosure will enable persons skilled in the art to derive additional embodiments, improvements, and/or applications. Therefore, the scope of the present invention should be limited only to the extent of the following claims.

What is claimed is:

1. An exercise apparatus, comprising:

a frame having a base that is configured to rest upon a floor surface;

a front crank rotatably mounted on a forward portion of the frame, wherein the front crank includes a first left connection point, a discrete, second left connection point, a first right connection point, and a discrete, second right connection point;

a rear crank rotatably mounted on a rearward portion of the frame, and constrained to rotate together with the front crank;

a left rail movably interconnected between a respective portion of the rear crank and the first left connection point on the front crank;

a right rail movably interconnected between a respective portion of the rear crank and the first right connection point on the front crank;

a left foot support and a right foot support, wherein each said foot support is movably mounted on a respective said rail;

a left rocker link and a right rocker link, wherein each said rocker link is pivotally mounted on the frame and operatively connected to a respective said foot support;

a left drive link movably interconnected between the left rocker link and the second left connection point on the front crank, wherein the left drive link remains generally vertical during rotation of the front crank, and links rotation of the front crank to both pivoting of the left rocker link and movement of the left foot support along the left rail; and a right drive link movably interconnected between the right rocker link and the second right connection point on the front crank, wherein the right drive link remains generally vertical during rotation of the front crank, and links rotation of the front crank to both pivoting of the right rocker link and movement of the right foot support along the right rail.

2. The exercise apparatus of claim 1, wherein an angle of approximately sixty degrees is defined between each said first connection point and a respective said second connection point.

3. The exercise apparatus of claim 1, wherein an upper distal end of each said rocker link is sized and configured for grasping.

4. The exercise apparatus of claim 1, wherein each said foot support is a skate that is rollably mounted on a respective rail.

5. The exercise apparatus of claim 1, wherein each said drive link is selectively adjustable along a respective said rocker link.

6. The exercise apparatus of claim 1, wherein a left bearing assembly is disposed between the first left connection point and the second left connection point on the front crank, and a right bearing assembly is disposed between the first right connection point and the second right connection point on the front crank.

7. The exercise apparatus of claim 1, wherein each said first connection point is disposed between left and right front bearing assemblies.

8. The exercise apparatus of claim 1, wherein all points on each said rail are constrained to travel through respective circular paths, and all points on each said foot support are constrained to travel through respective elliptical paths.

9. The exercise apparatus of claim 8, wherein each of said elliptical paths has a respective minor axis that is equal to a diameter defined by the circular paths, and a respective major axis that is relatively longer.

10. The exercise apparatus of claim 1, wherein each said rocker link pivots about a common pivot axis, and each said rocker link includes a tubular portion that extends along the pivot axis, and a handlebar portion that is secured to an outboard end of a respective tubular portion, and an opposite, distal portion that is secured to an opposite, inboard end of a respective tubular portion, and that is linked to a respective foot support.

11. An exercise apparatus, comprising:

a frame having a base that is configured to rest upon a floor surface;

a front crank rotatably mounted on a forward portion of the frame for rotation about a front crank axis;

a rear crank rotatably mounted on a rearward portion of the frame for rotation about a rear crank axis, and constrained to rotate together with the front crank;

a left rail and a right rail, wherein each said rail is constrained to rotate together with a respective portion of the rear crank and a respective portion of the front crank;

a left foot support and a right foot support, wherein each said foot support is movably mounted on a respective said rail;

a left rocker link and a right rocker link, wherein each said rocker link is pivotally mounted on the frame for pivoting about a common pivot axis, and each said rocker link includes a first member that extends from the pivot axis to a distal end that is sized and configured for grasping, a second member that extends from the pivot axis to a distal end that is operatively connected to a respective said foot support, and an intermediate third member that angles forward relative to the second member;

a left drive link movably interconnected between a respective said third member and a respective portion of the front crank, wherein the left drive link remains generally vertical during rotation of the front crank, and links rotation of the front crank to both pivoting of the left rocker link and movement of the left foot support along the left rail; and a right drive link movably interconnected between a respective said third member and a respective portion of the front crank, wherein the right drive link remains generally vertical during rotation of the front crank, and links rotation of the front crank to both pivoting of a respective said first member and movement of the right foot support along the right rail.

12. The exercise apparatus of claim 11, wherein the respective portion of the front crank that is connected to the left drive link is on a crank disc, and the crank disc is connected to a flywheel by at least one belt.

13. The exercise apparatus of claim 12, wherein the crank disc and the left rail are disposed on opposite sides of a bearing assembly.

14. The exercise apparatus of claim 11, wherein the respective portion of the front crank that is connected to the right drive link is on a first crank sprocket, and the first crank sprocket is connected to a second crank sprocket by a chain, and the second crank sprocket is part of the rear crank.

15. The exercise apparatus of claim 14, wherein the first crank sprocket and the right rail are disposed on opposite sides of a bearing assembly.

16. An exercise apparatus, comprising:

a frame having a base that is configured to rest upon a floor surface;

a front crank rotatably mounted on a forward portion of the frame for rotation about a front crank axis;

a rear crank rotatably mounted on a rearward portion of the frame for rotation about a rear crank axis, and constrained to rotate together with the front crank;

a left rail and a right rail, wherein each said rail is constrained to rotate together with a respective portion of the rear crank and a respective portion of the front crank;

a left foot support and a right foot support, wherein each said foot support is movably mounted on a respective said rail;

a left rocker link and a right rocker link, wherein each said rocker link is pivotally mounted on the frame for pivoting about a common pivot axis, and each said rocker link includes an upper distal end that is sized and configured for grasping, and a lower distal end that is operatively connected to a respective foot support;

a left linking means, interconnected between the front crank and the left rocker link, for linking rotation of the front crank to pivoting of the left rocker link and movement of the left foot support relative to the left rail in such a manner that the upper distal end of the left rocker link moves rearward as the left foot support moves forward; and a right linking means, interconnected between the front crank and the right rocker link, for linking rotation of the front crank to pivoting of the right rocker link and movement of the right foot support relative to the right rail in such a manner that the upper distal end of the right rocker link moves rearward as the right foot support moves forward.

17. The exercise apparatus of claim 16, wherein each said linking means includes a drive link interconnected between a respective said front crank and a respective said rocker link.

18. The exercise apparatus of claim 17, wherein each said drive link is adjustably connected to a respective said rocker link.

19. An exercise apparatus, comprising:

a frame having a base that is configured to rest upon a floor surface;

a front crank rotatably mounted on a forward portion of the frame for rotation about a front crank axis;

a rear crank rotatably-mounted on a rearward portion of the frame for rotation about a rear crank axis, and constrained to rotate together with the front crank;

a left rail and a right rail, wherein each said rail is constrained to rotate together with a respective portion of the rear crank and a respective portion of the front crank;

a left foot support and a right foot support, wherein each said foot support is movably mounted on a respective said rail;

a left rocker link and a right rocker link, wherein each said rocker link is pivotally mounted on the frame for pivoting about a common pivot axis, and each said rocker link includes a lower distal end that is operatively connected to a respective foot support;

an adjustable left linking means, interconnected between the front crank and the left rocker link, for linking rotation of the front crank to pivoting of the left rocker link and movement of the left foot support relative to the left rail; and an adjustable right linking means, interconnected between the front crank and the right rocker link, for linking rotation of the front crank to pivoting of the right rocker link and movement of the right foot support relative to the right rail, wherein each said linking means is adjustable between a first arrangement, wherein a respective said foot support moves through a first elliptical foot path having a first major axis, and a second arrangement, wherein a respective said foot support moves through a second elliptical foot path having a relatively larger, second major axis with a midpoint that is rearward in comparison to a midpoint associated with the first major axis.

20. An exercise apparatus, comprising:

a frame having a base that is configured to rest upon a floor surface;

a front crank rotatably mounted on a forward portion of the frame for rotation about a front crank axis;

a rear crank rotatably mounted on a rearward portion of the frame for rotation about a rear crank axis, and constrained to rotate together with the front crank;

a left rail constrained to rotate together with a left portion of the rear crank and a left portion of the front crank, wherein the left portion of the front crank is inboard relative to a left bearing assembly on the frame;

a right rail constrained to rotate together with a right portion of the rear crank and a right portion of the front crank, wherein the right portion of the front crank is inboard relative to a right bearing assembly on the frame;

a left foot support and a right foot support, wherein each said foot support is movably mounted on a respective said rail;

left rocker link and a right rocker link, wherein each said rocker link is pivotally mounted on the frame for pivoting about a common pivot axis, and each said rocker link includes a lower distal end that is operatively connected to a respective foot support;

a left drive link movably interconnected between the left rocker link and a portion of the front crank that is outboard relative to the left bearing assembly, wherein the left drive link links rotation of the front crank to both pivoting of the left rocker link and movement of the left foot support along the left rail; and a right drive link movably interconnected between the right rocker link and a portion of the front crank that is outboard relative to the right bearing assembly, wherein the right drive link links rotation of the front crank to both pivoting of the right rocker link and movement of the right foot support along the right rail.

* * * * *